US010190446B2

(12) United States Patent
Cecur

(10) Patent No.: US 10,190,446 B2
(45) **Date of Patent: *Jan. 29, 2019**

(54) VALVE TRAIN ASSEMBLY

(71) Applicant: EATON INTELLIGENT POWER LIMITED, Dublin (IE)

(72) Inventor: Majo Cecur, Rivarolo Canavese (IT)

(73) Assignee: EATON INTELLIGENT POWER LIMITED, Dublin (IE)

( * ) Notice: Subject to any disclaimer, the term of this patent is extended or adjusted under 35 U.S.C. 154(b) by 59 days.

This patent is subject to a terminal disclaimer.

(21) Appl. No.: 15/346,770

(22) Filed: Nov. 9, 2016

(65) Prior Publication Data

US 2017/0051638 A1 Feb. 23, 2017

Related U.S. Application Data

(63) Continuation of application No. 14/411,524, filed as application No. PCT/EP2013/063787 on Jul. 1, 2013, now Pat. No. 9,512,745.

(30) Foreign Application Priority Data

Jun. 29, 2012 (GB) ..... 1211534.1

(51) Int. Cl.
*F01L 1/18* (2006.01)
*F01L 1/24* (2006.01)
(Continued)

(52) U.S. Cl.
CPC ..... *F01L 1/2411* (2013.01); *F01L 1/143* (2013.01); *F01L 1/18* (2013.01); *F01L 1/181* (2013.01);
(Continued)

(58) Field of Classification Search
CPC ..... F01L 1/24; F01L 1/143; F01L 1/18; F01L 1/181; F01L 1/2411
(Continued)

(56) References Cited

U.S. PATENT DOCUMENTS 2,380,051 A 7/1945 Kettering
3,140,698 A 7/1964 Voorhies
(Continued)

FOREIGN PATENT DOCUMENTS

DE 4338845 A1 5/1995
DE 4410122 A1 9/1995
(Continued)

*Primary Examiner* — Ching Chang
(74) *Attorney, Agent, or Firm* — Leydig, Voit & Mayer, Ltd.

(57) ABSTRACT

A valve train assembly includes a valve bridge assembly. The valve bridge assembly includes: a valve bridge; a first cavity formed towards a first end portion of the valve bridge; and a hydraulic lash adjuster (HLA) disposed within the first cavity, the HLA for engaging a first valve stem. The valve train assembly further includes: a pivotally mounted first rocker arm for engaging the valve bridge and to pivot in response to a rotating first cam to cause a first valve lift event in an engine cycle. The first rocker arm includes: a rocker arm cavity formed within an end portion thereof; and a control capsule disposed within the rocker arm cavity, wherein the control capsule is configurable in an ON configuration and an OFF configuration.

9 Claims, 12 Drawing Sheets

(51) Int. Cl.

| | |
|---|---|
| ***F01L 1/14*** | (2006.01) |
| ***F01L 1/25*** | (2006.01) |
| ***F01L 1/26*** | (2006.01) |
| ***F01L 13/06*** | (2006.01) |
| ***F02D 13/04*** | (2006.01) |

(52) U.S. Cl.
CPC ..... *F01L 1/24* (2013.01); *F01L 1/25* (2013.01); *F01L 1/26* (2013.01); *F01L 1/267* (2013.01); *F01L 13/06* (2013.01); *F01L 13/065* (2013.01); *F02D 13/04* (2013.01)

(58) Field of Classification Search
USPC ..... 123/90.39, 90.44, 90.45
See application file for complete search history.

(56) References Cited

U.S. PATENT DOCUMENTS

| | | | | |
|---|---|---|---|---|
| 4,677,723 | A | 7/1987 | Greene, Sr. | |
| 4,924,821 | A | 5/1990 | Teerman | |
| 5,150,672 | A | 9/1992 | Fischer et al. | |
| 5,501,187 | A | 3/1996 | Speil et al. | |
| 6,334,429 | B1 | 1/2002 | Little, Jr. | |
| 7,984,705 | B2 | 7/2011 | Yang | |
| 8,210,144 | B2 | 7/2012 | Langewisch | |
| 8,413,626 | B2 | 4/2013 | MacVicar | |
| 8,578,901 | B2 | 11/2013 | Ruggiero et al. | |
| 8,627,791 | B2 | 1/2014 | Janak et al. | |
| 8,813,719 | B2 | 8/2014 | Sailer et al. | |
| 8,851,048 | B2 | 10/2014 | Meistrick | |
| 9,512,745 | B2 * | 12/2016 | Cecur ..... | F01L 1/143 123/90.39 |
| 2009/0064955 | A1 | 3/2009 | Rauch et al. | |
| 2009/0199802 | A1 | 8/2009 | MacVicar | |

FOREIGN PATENT DOCUMENTS

| | | | |
|---|---|---|---|
| DE | 19836906 | A1 | 2/2000 |
| EP | 0504128 | A1 | 9/1992 |
| EP | 2034138 | A2 | 3/2009 |
| WO | WO 2010078280 | A2 | 7/2010 |
| WO | WO 2011015603 | A2 | 2/2011 |

* cited by examiner

VALVE TRAIN ASSEMBLY

CROSS-REFERENCE TO PRIOR APPLICATIONS

This application is a continuation of a U.S. patent application Ser. No. 14/411,524, filed on Dec. 29, 2014, which is a U.S. National Stage application under 35 U.S.C. § 371 of International Application No. PCT/EP2013/063787, filed on Jul. 1, 2013, which claims benefit to British Patent Application No. 1211534.1, filed on Jun. 29, 2012. The International Application was published in English on Jan. 3, 2014, as WO 2014/001560 A1 under PCT Article 21(2). The entire disclosures of the foregoing applications are hereby incorporated by reference herein.

FIELD

The present invention relates to a valve train assembly.

BACKGROUND

Compression engine brakes are typically used as auxiliary brakes, in addition to wheel brakes, on relatively large vehicles, for example trucks, powered by heavy or medium duty diesel engines. A compression engine braking system is arranged, when activated, to provide an additional opening of an engine cylinder's exhaust valve when the piston in that cylinder is close to the top-dead-center position of its compression stroke so that compressed air is released through the exhaust valve. This causes the engine to function as a power consuming air compressor which slows the vehicle.

In a typical valve train assembly used with a compression engine brake, the exhaust valve is actuated by a rocker arm which engages the exhaust valve by means of a valve bridge. The rocker arm rocks in response to a cam on a rotating cam shaft and presses down on the valve bridge which itself presses down on the exhaust valve to open it. A hydraulic lash adjuster may also be provided in the valve train assembly to remove any lash (i.e. gap) that develops between components in the valve train assembly.

There is a need for an improved valve bridge and in particular, but not exclusively, one that can be used in combination with a compression engine braking system.

SUMMARY

In an embodiment, the present invention provides a valve train assembly, the valve train assembly comprising: a valve bridge assembly, the valve bridge assembly comprising: a valve bridge; a first cavity formed towards a first end portion of the valve bridge; and a hydraulic lash adjuster (HLA) disposed within the first cavity, the HLA being configured to engage a first valve stem. The valve train assembly further comprises: a pivotally mounted first rocker arm configured to engage the valve bridge and to pivot in response to a rotating first cam to cause a first valve lift event in an engine cycle. The first rocker arm comprises: a rocker arm cavity formed within an end portion thereof; and a control capsule disposed within the rocker arm cavity, wherein the control capsule is configurable in an ON configuration and an OFF configuration, wherein, in the ON configuration the pivoting of the first rocker arm is configured to cause the first valve lift event and, in the OFF configuration, the control capsule is configured to prevent the pivoting of the first rocker arm from causing the first valve lift event.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
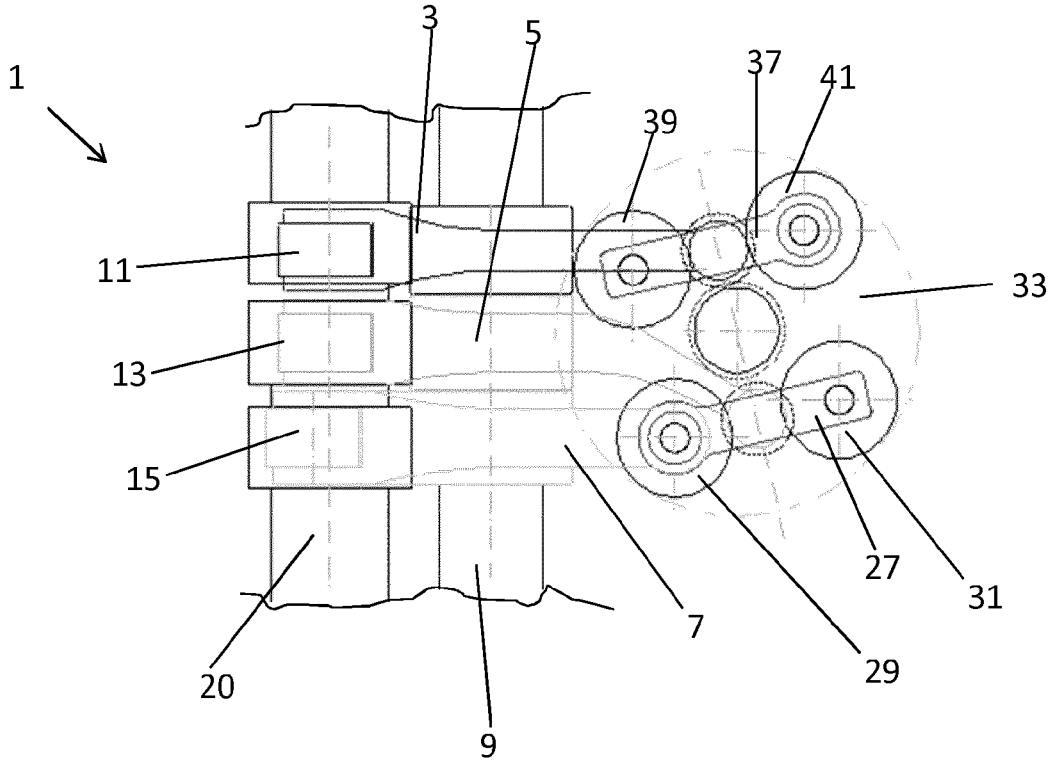
FIG. 1 is a schematic plan view of a valve train assembly.
Figure 2:
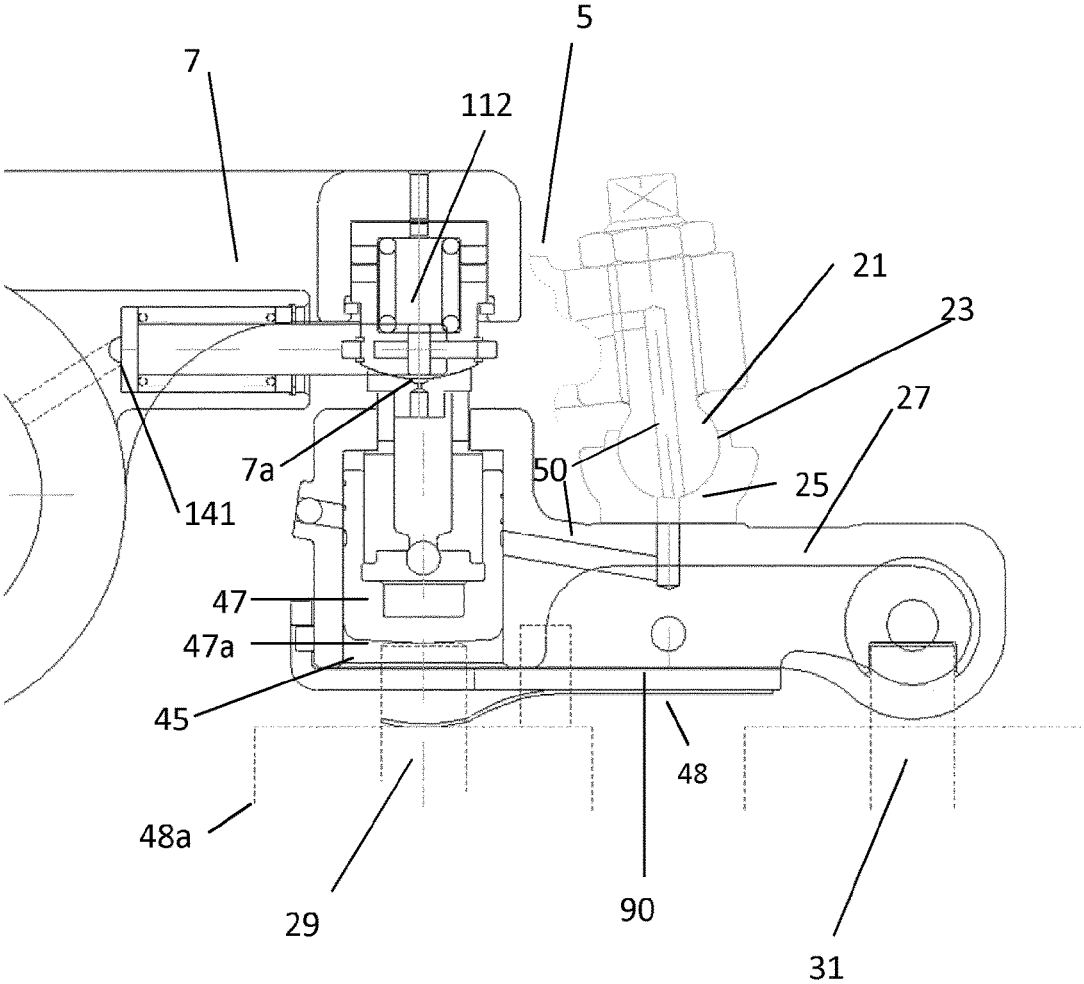
FIG. 2 is a schematic cross sectional side view of part of the valve train assembly.

FIGS. 1 and 2 schematically illustrate a valve train assembly 1 comprising an intake rocker arm 3, an exhaust rocker arm 5 and an engine brake rocker arm 7 all mounted, in parallel, for pivotal movement on a common rocker shaft 9. The person skilled in the art will recognize that the valve train assembly 1 is a so called 'skewed valve' assembly. Each of the rocker arms 3, 5 and 7 comprises at one end a respective rotatably mounted roller 11, 13 and 15. The intake rocker arm's roller 11 is for engaging an intake cam, the exhaust rocker arm's roller 13 is for engaging an exhaust cam, and the engine brake rocker arm' roller 15 is for engaging an engine brake cam, which cams are mounted on a common cam shaft 20.

As shown in FIG. 2, the exhaust rocker arm 5 is provided at its other end with a spigot 21 located in a complimentary shaped socket 23 of an exhaust rocker arm E-foot 25. The exhaust rocker arm E-foot 25 engages an exhaust rocker arm valve bridge 27 which operates a pair of exhaust valves 29 and 31 of an engine cylinder 33.

Similarly, the intake rocker arm 3 is provided at its other end with a spigot located in a complimentary shaped socket of an intake rocker arm E-foot. The intake rocker arm E-foot engages an intake rocker arm valve bridge 37 which operates a pair of intake valves 39 and 41 of the engine cylinder 33.

During normal powered engine operation (i.e. when the engine is generating power strokes) a lobe of the intake cam causes the intake rocker arm 3 to pivot about the rocker shaft 9 to push the intake valve bridge 37 and hence the intake valves 39 and 41 downwards to open them for the intake part of the engine cycle. Likewise, later in the engine cycle, a lobe of the exhaust cam causes the exhaust rocker arm 5 to pivot about the rocker shaft 9 to push the exhaust valve bridge 27 and hence the exhaust valves 29 and 31 downwards to open the them for the exhaust part of the engine cycle. As is conventional, all of the valves 29, 31, 39, 41 are provided with valve return springs biased to cause the valves 29, 31, 39, 41 to return to their closed positions as the relevant cam lobe passes out of engagement with its associated roller 11 or 13.

Figure 3:
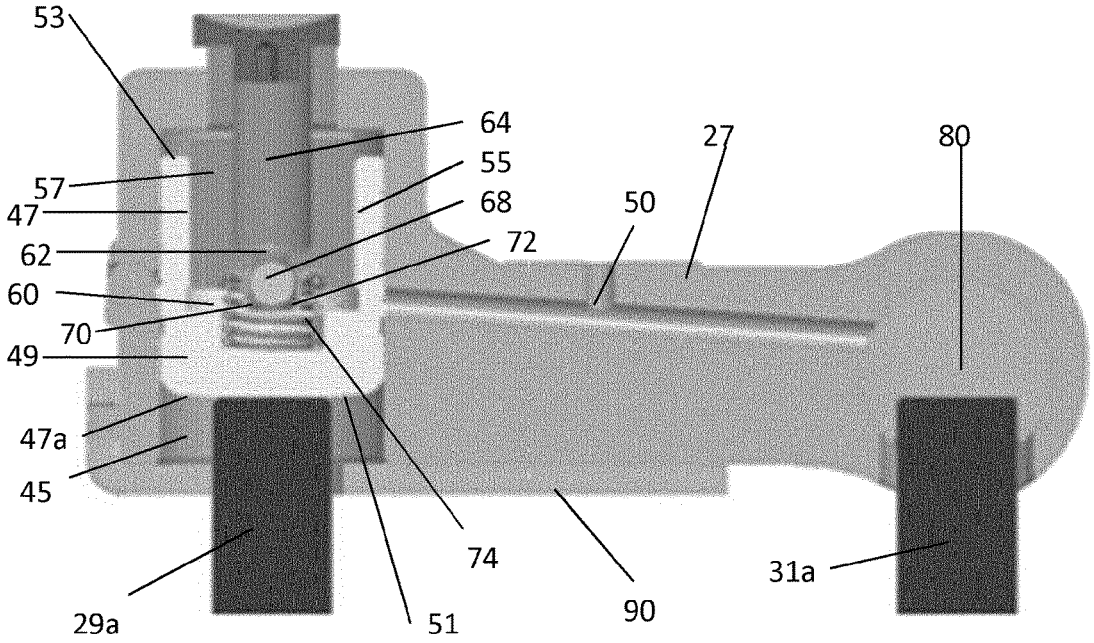
FIG. 3 is a schematic cross sectional side view showing a valve bridge.

As shown in FIGS. 2 and 3, the exhaust valve bridge 27 comprises at a first end a cavity 45 in which is disposed a hydraulic lash adjuster (HLA) 47. As seen in FIG. 2, at one end 7*a*, the exhaust rocker arm 7 is provided with an engine brake control capsule 112 which contacts the HLA 47. As will be explained in more detail below, the control capsule 112 is selectably configurable in either an engine brake 'ON' configuration or an engine brake 'OFF' configuration. In the engine brake 'ON' configuration, the pivoting of the engine brake rocker arm 7 in response to a rotating engine brake cam pushes down on the HLA which in turn pushes down on the exhaust valve 29 which causes an additional valve lift of the exhaust valve 29, once per engine cycle, to provide an engine brake event. In contrast, in the engine brake 'OFF' configuration, the pivoting of the engine brake rocker arm 7 is absorbed by a 'lost motion stroke' of the engine brake control capsule 112 and so the additional valve lift of the exhaust valve 29 is inhibited.

The hydraulic lash adjuster 47 comprises an outer body 49 having a closed end 51 and an open end 53 and defines a longitudinal bore 55 between the closed 51 and open 53 ends. The closed end 51 is for engaging a valve stem 29*a* of the valve 29. A plunger assembly 57 is mounted for sliding movement back and forth within the bore 55 and its upper end extends above the bore 55.

The plunger assembly 57 and the outer body 49 define between them a first oil pressure chamber 60 towards the bottom of the bore 55 (i.e. towards the bottom of the HLA 47). An aperture 62 at the bottom of the plunger assembly 57 allows oil to flow from a second oil pressure chamber 64, or oil reservoir, within the plunger assembly 57 into the first oil chamber 60. Oil is kept supplied to the second oil pressure chamber 64 from the engine's oil supply via a connected series of oil supply conduits 50 formed through the rocker shaft 9, exhaust rocker arm 5, E-Foot 25 and exhaust valve bridge 27.

Below the aperture 62, a ball valve is provided which comprises a check ball 68 captured by a cage 70 and biased by a spring 72 to a position closing the aperture 62. The plunger assembly 57 is biased outwardly of the outer body 49 by means of a spring 74 held within the first oil pressure chamber 60.

In use, the spring 74 expands the overall length of the hydraulic lash adjuster 47 by pushing the plunger assembly 57 outwardly of the outer body 49 so as to take up any slack that has developed in the valve train assembly 1. During the course of this motion, oil flows from the second oil chamber 64 into the first oil chamber 60 through the aperture 62. When pressure is applied to the upper end of the HLA 47 inward movement of the plunger assembly 57 is inhibited by the high pressure of oil in the first oil chamber 60. The oil in the first oil chamber 60 cannot flow back into the second oil chamber 64 because of the ball 68. As is standard, oil can escape the first oil chamber 60 by leaking between the surface of the bore 55 and the outer surface of the plunger assembly 57, but this can occur only very slowly (particularly if the oil is cold) because the bore 55 and the plunger assembly 57 are made to tight tolerances to restrict oil flow.

The HLA 47 compensates valve lash by expanding to compensate for all lashes on both valve tips. To this end, the HLA 47 will expand until the upper surface of the exhaust valve bridge 27 is in contact and flush with the lower surface of the E-foot 25, whilst the lower surface of the HLA 47 sits without any lash on the tip of the valve 29 and a further contact surface of a support member 80 sits without any lash on the tip of the valve 30.

The exhaust valve bridge 27, after having moved to compensate for all lashes, will not necessarily be horizontal, and for this reason, in this example, the lower surface 47*a* of the HLA 47 is formed as a part section of a spherical surface or relatively large radius of curvature and, in addition, the exhaust valve bridge 27 is mounted for pivotal movement about the support member 80 which is received within an aperture at one end of the exhaust valve bridge 27. The radius of curvature of the lower surface 47*a* helps ensure that good contact is maintained between the lower surface 47*a* and the tip of the valve 29, particularly when the valve bridge 27 is not horizontal, and that that contact is away from the edge of the tip of the valve 29.

Figure 4A:
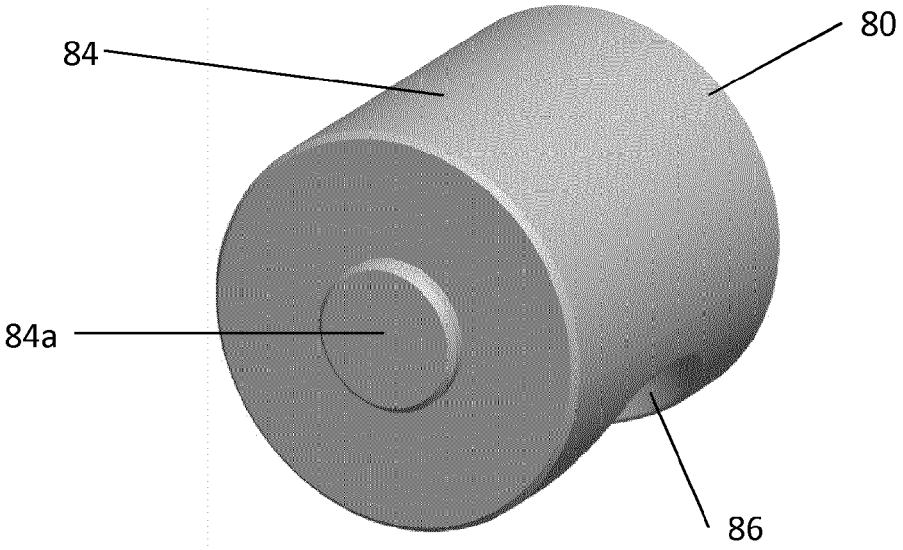
FIG. 4*a* is a perspective view of a component of the valve bridge.
Figure 4B:
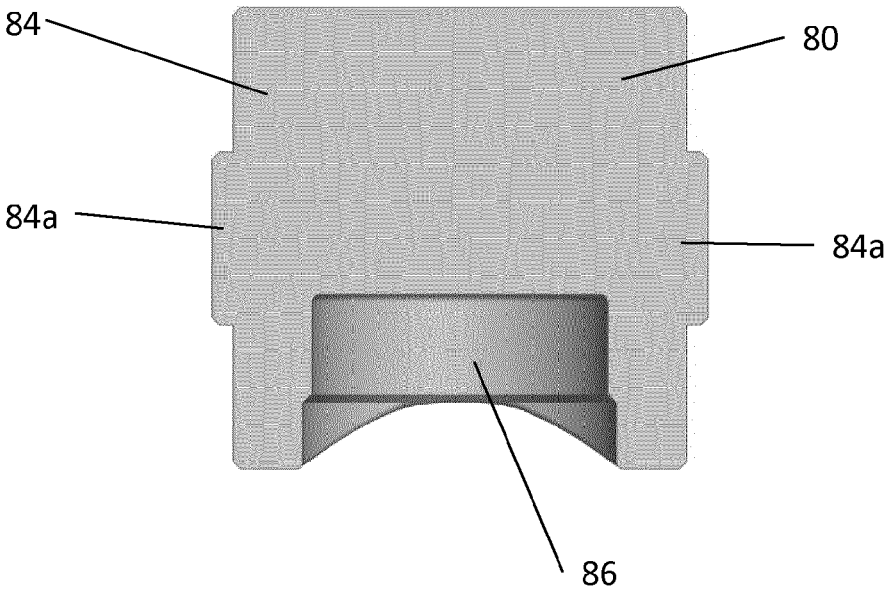
FIG. 4*b* is a cross sectional view of the component.

As illustrated in FIGS. 4*a* and 4*b*, the support member 80 comprises a generally tubular body 84 which has a pair of lugs 84*a*, one extending from each end of the tubular body 84. The tubular body is further provide with a blind bore 86 formed through part of the surface that faces generally downwards (in the sense of the Figures) in use. The bore 86, which is generally circular in cross section, receives the valve tip 31*a* of the valve 31. The diameter of the bore 86 is only slightly bigger than the diameter of the valve tip so that the valve tip fits tightly in the bore 86 with the blind end of the bore 86 defining the further contact surface that sits on the valve tip 30.

In this example, pivoting of the exhaust valve bridge 27 about the support member 80 helps ensure that good contact is maintained between the support member 80 and the tip of the valve 30, when the valve bridge 27 is not horizontal. In an alternative embodiment (not illustrated), the valve bridge 27 does not comprise the support member 180, but instead, in order to maintain good contact with the tip of the valve 30, it is provided with a fixed valve tip contact surface (i.e. one about which the valve bridge 27 cannot pivot) which similarly to the lower surface 47*a* of the HLA 47, is formed as a part section of a spherical surface or relatively large radius of curvature.

Figure 5:
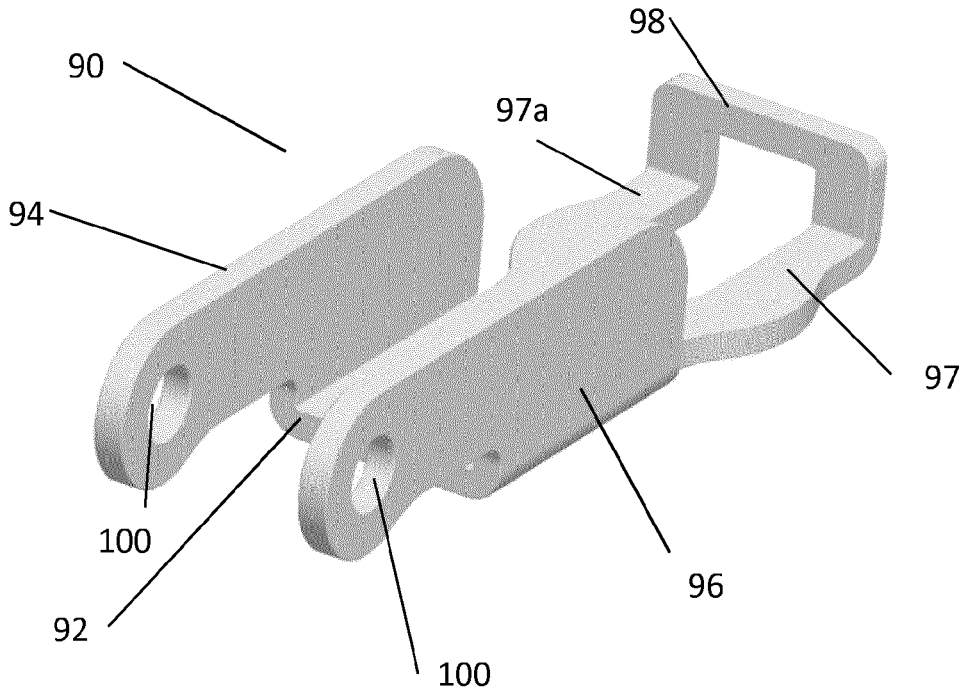
FIG. 5 is a perspective view of a clip component.

The exhaust valve bridge 27 is further provided with a clip 90, which is shown in detail in FIG. 5, and which is helps maintain the valve bridge 27 in place on the tips of the valves 29 and 30. The clip 90 comprises a base section 92, a first side section 94 and a second side section 96, one arranged either side of the base section 96, which project generally perpendicularly from the base section 92. One end of the base section 92 extends away from the first 94 and second 96 side sections and bifurcates into first 97*a* and second 97*b* parts which are integrally connected by a generally C shaped cross piece 98. At its other end, the first 94 and second 96 side sections overhang the base section 92 and each of the first 94 and second 96 side sections is provided with a respective one of a pair of coaxial apertures 100. As best illustrated in FIG. 7, the clip 90 clips snuggly onto the exhaust valve bridge 27 with each lug 84*a* of the body 84 received in a respective one of the apertures 100 and a projection 102 at the first end of the exhaust valve bridge 27 engaging the underside of the C shaped cross piece 98.

Figure 6:
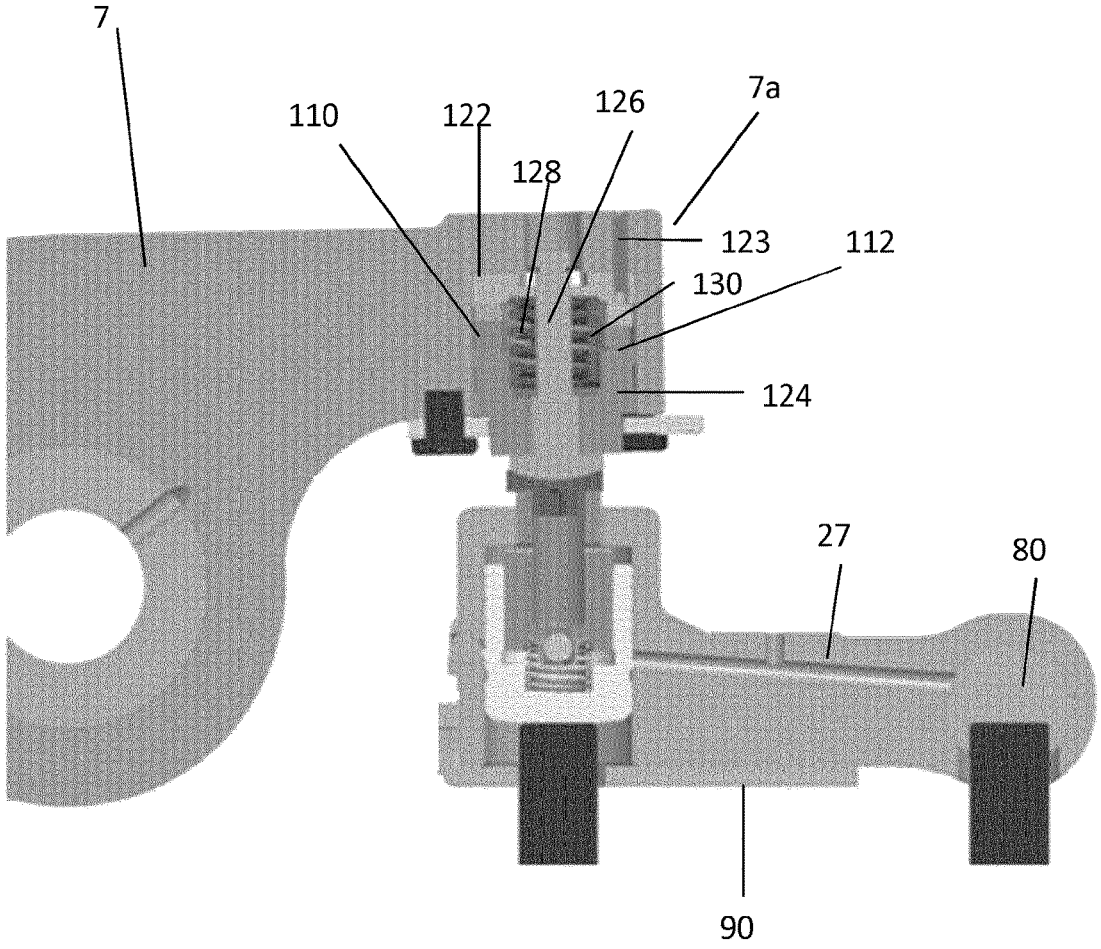
FIG. 6 is a schematic side view in cross section of an exhaust brake rocker arm and a valve bridge.
Figure 7:
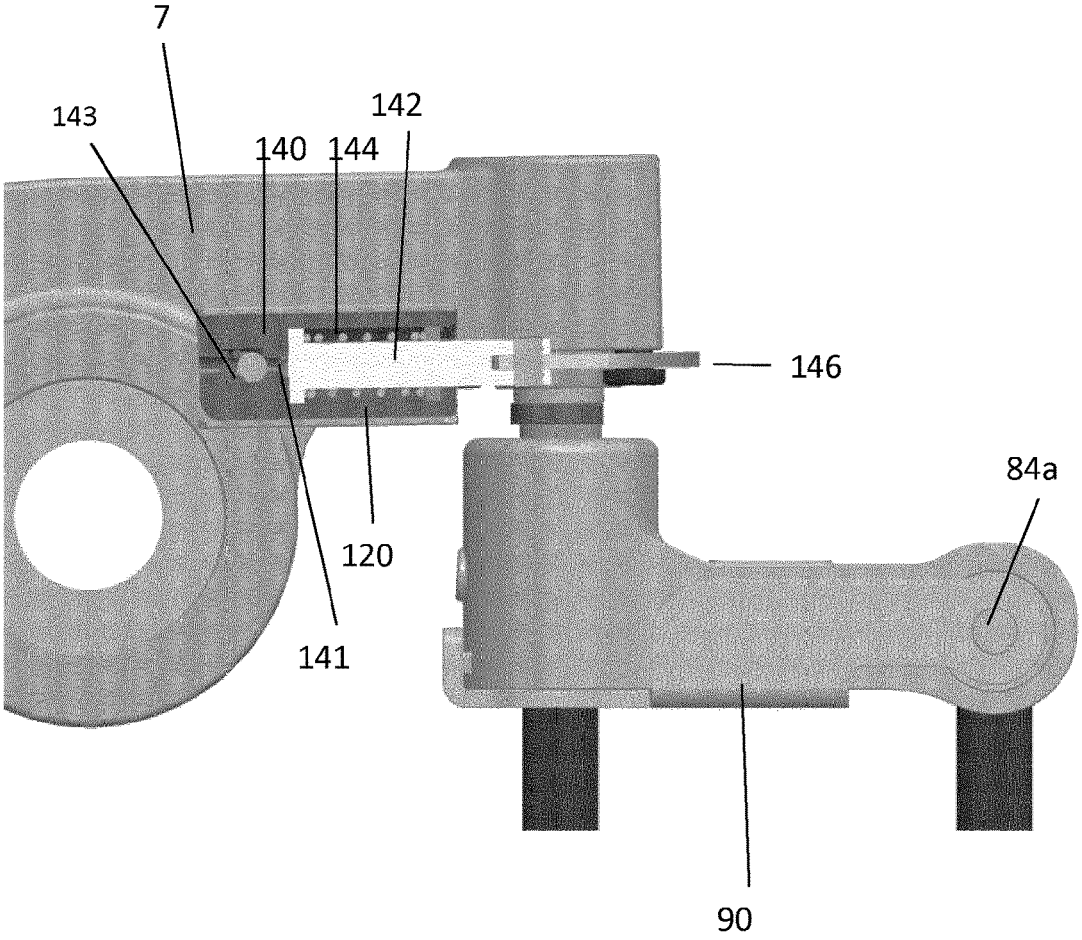
FIG. 7 is a schematic side view of the exhaust brake rocker arm and the valve bridge showing part of an actuator in cross section.

Referring now to FIGS. 6 and 7, the engine brake rocker arm 7 comprises at an end 7*a*, a cavity 110 containing the engine brake control capsule 112. A similar capsule is described in our application WO 2011/015603. The engine brake control capsule 112 is configurable by means of an actuator 120 in either an engine brake 'ON' configuration, or engine brake 'OFF' configuration. In the engine brake 'ON' configuration, the pivoting of the engine brake rocker arm 7 in response to a rotating engine brake cam causes an additional valve lift of the exhaust valve 29, once per engine cycle, to provide an engine brake event. In contrast, in the engine brake 'OFF' configuration, the pivoting of the engine brake rocker arm 7 is absorbed by a 'lost motion stroke' of the engine brake control capsule 112 and so the additional valve lift of the exhaust valve 29 is inhibited.

The engine brake control capsule 112 comprises a first hollow member 122, a second hollow member 124, a push member 126 and a spring 128. The actuator 120 rotates the second hollow member 124 to configure the engine brake control capsule 112 in the engine brake 'ON' configuration, or the engine brake 'OFF' configuration. The first hollow member 122 is provided with a retaining pin 123 that prevents rotation of the first hollow member 122. An open end of the first member 122 faces an open end of the second member 124 so that the first member 122 and second member 124 define a chamber 130 in which the spring 128 is located. The push member 126 is disposed along the longitudinal axis of the brake capsule 112 through the chamber 130 and comprises an upper end which protrudes through a hole formed in the closed end of the first hollow member 122 and a lower end which extends through a hole formed in the closed end of the second member 124. The open ends of the first and second members are crenulated around their circumferences, each comprising a sequence of alternating raised parts and recesses.

Figure 8:
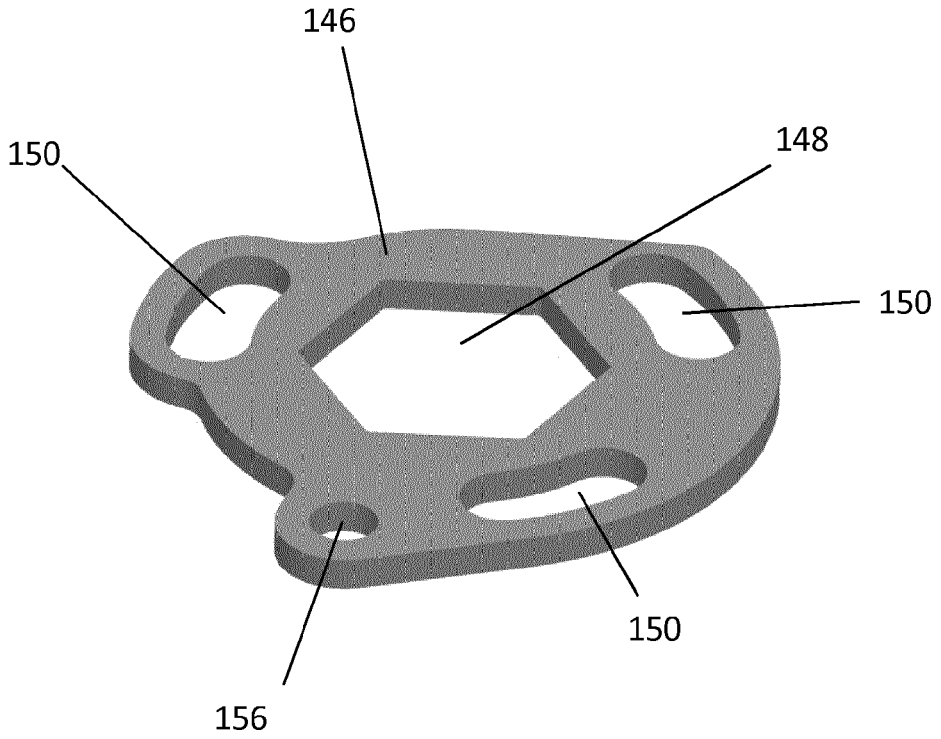
FIG. 8 shows a component of an actuator.

The actuator 120 comprises a cylinder 140 provided on a side of the rocker arm 7 and containing a piston 142 mounted for reciprocating movement within the cylinder between an engine brake off position, in which the piston is fully retracted, and an engine brake on position, in which the piston is fully extended. The actuator 120 further comprises a return spring 144 disposed within the cylinder 140 and arranged to bias the piston 142 towards the engine brake ON position. The piston 142 comprises an end which extends outside of the cylinder 140 and which is fixed, for example, by a rivet, to a planar ring member 146. As best seen in FIG. 8, the planar ring member 146 comprises a central hexagonal shaped hole 148, through which the second hollow member 124 extends. The ring member 146 further comprises three arcuate slots 150 spaced apart around its circumference, through each of which extends a respective guide pin 152. Each guide pin 152 is fixed in and extends downwards from the rocker arm 7. The ring member 146 further comprises a hole 154 my means of which it can be attached, for example, by a rivet to the piston 142.

Figure 9A:
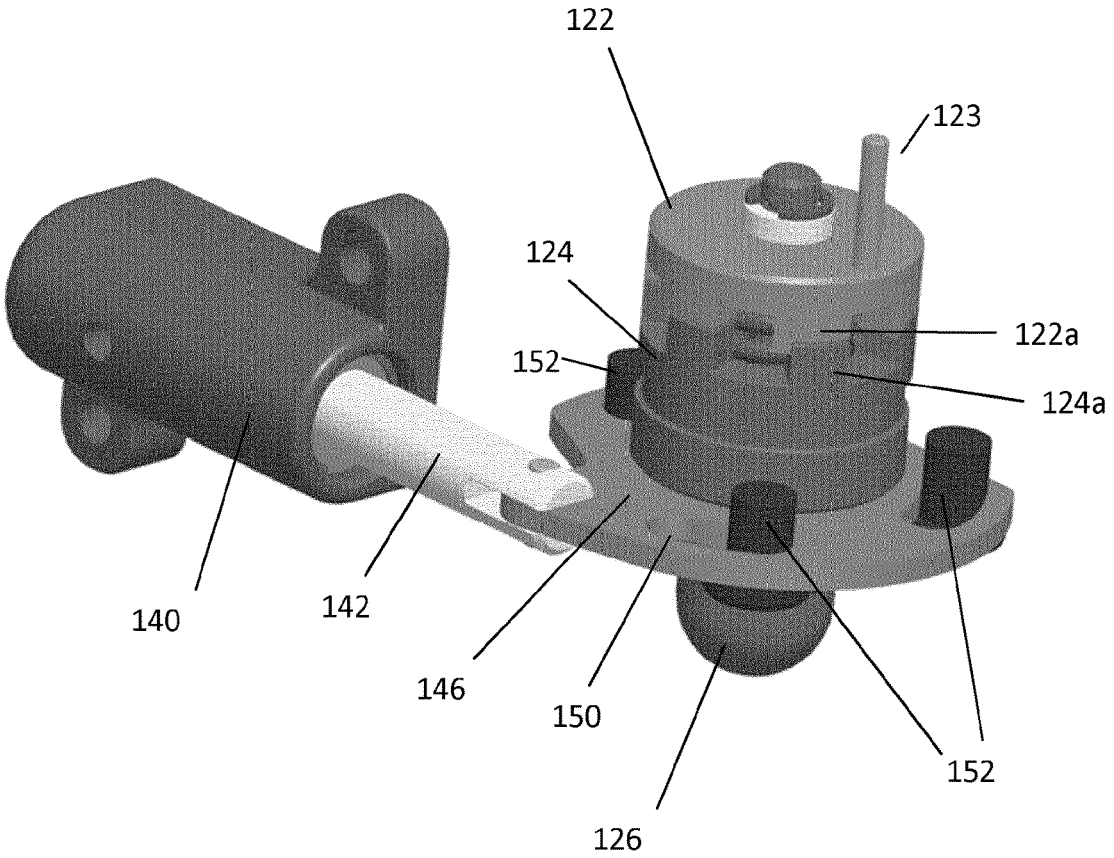
FIG. 9*a* shows an actuator and an engine brake capsule in a first configuration.

In the default engine brake 'ON' configuration, shown in FIG. 9*a*, each raised part 122*a* of the open end of the first hollow member 122 faces a raised part 124*a* of the open end of the second hollow member 124 and each guide pin 152 is at a first end (the right hand end as viewed in FIG. 9*a*) of its slot 150.

During engine operation when the engine brake is ON, once per cam shaft rotation, a lobe of the engine brake cam causes the exhaust brake rocker arm 7 to pivot about the rocker shaft 9 so that the first hollow member pushes 122 down on the second hollow member 124 which in turn causes the push member 126 to push down on the HLA 47 (i.e. the capsule behaves as a solid body). Hence, the HLA 47 pushes down on the exhaust valve 29 which opens to provide an engine brake event timed to coincide with a compression stroke of the piston. A valve return spring causes the exhaust valve 29 to return to its closed position as the exhaust cam lobe passes out of engagement with its associated roller.

As is illustrated in FIG. 2, a biasing means 48, for example a leaf spring, is arranged to bias the valve bridge 27 upwards when the engine brake rocker arm 7 acts downwards on the HLA 47 during an engine brake event, to maintain contact between the valve bridge 27 and the E foot 25 so that there is no break in the oil supply path 75 (which would allow air into the oil supply path). In this example, the biasing means 48 is seated upon a valve spring retainer 48*a*.

Figure 9B:
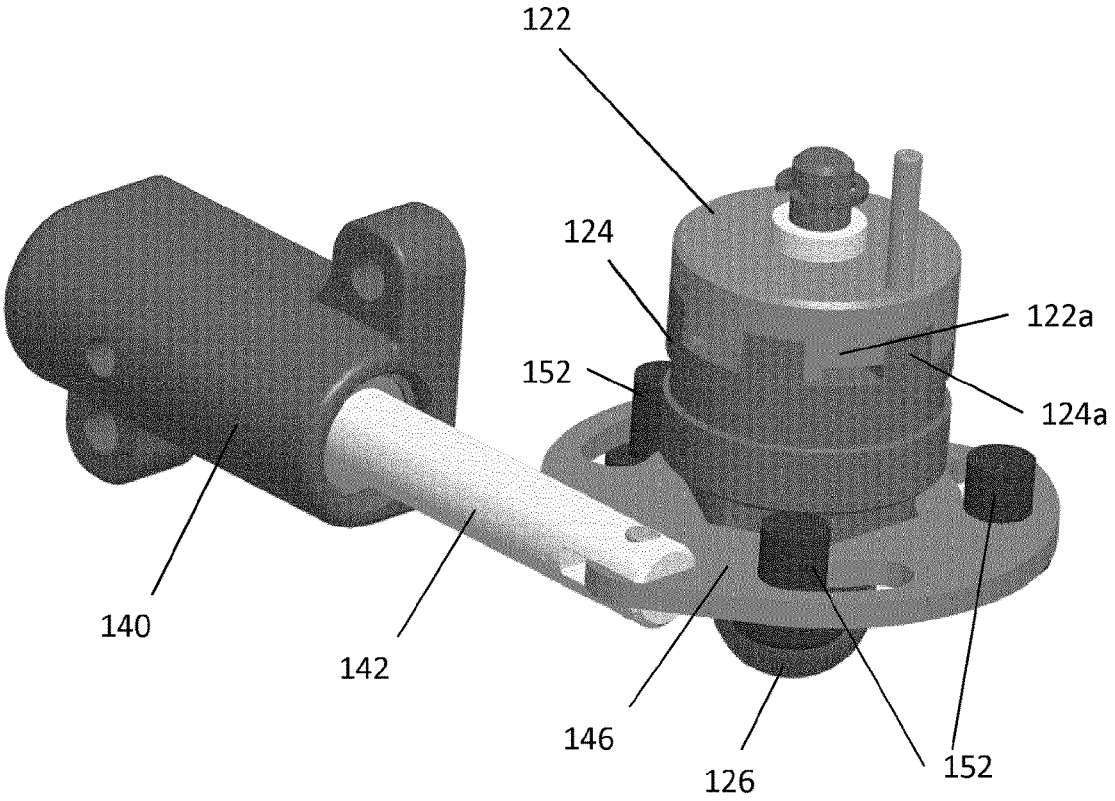
FIG. 9*b* shows the actuator and the engine brake capsule in a second configuration.

In order to deactivate the engine brake, an engine control system supplies hydraulic fluid (for example, oil), via fluid supply path 141 (best seen in FIG. 2) formed in the engine brake rocker arm 7, to the cylinder 140 causing the piston 142 to move from its retracted position to its extended position. The piston 142 moves the ring member 146 and hence the second member 124 into a configuration in which, as illustrated in FIG. 9*b*, each guide pin 152 is at a second end (the left hand end of the foremost pin as viewed in FIG. 9*b*) of its respective slot 150 and each raised part 122*a* of the open end of the first hollow member 122 faces a recess of the open end of the second hollow member 124 and each recess of the open end of the first hollow member 122 faces a raised part 124*a* of the open end of the second hollow member 124 and hence there is space between the two hollow members 122 and 124.

During engine operation when the engine brake is OFF, as the lobe of the engine brake cam causes the exhaust brake rocker arm 7 to pivot about the rocker shaft 9, the first member 122 and the ring member 146 move relative to the second member 124, which remains stationary. The first 122 and second 124 members remain out of contact throughout this movement, even at the bottom of the exhaust rockers arm's stroke, and therefore no force is exerted on the push member 126 and consequently the exhaust valve 29 does not open. As the exhaust brake rocker arm 7 returns to its starting position, the first member 122 and the ring member 146 return to their starting positions, the first member 122 under the action of the return spring 130. It should be appreciated that FIG. 9*b* illustrates the engine brake control capsule 112 at the end of the exhaust rocker arm's 7 lost motion stroke (i.e. when the first member 122 is fully depressed with respect to the second member 124.)

The actuator 102 is provided with a safety check valve 143, which is biased to a closed position, but which opens under increased fluid pressure in the cylinder 140 caused when the piston 142 is sometimes hit backwards into the cylinder 140. The safety check valve reliefs the increased fluid pressure in such circumstances, thereby avoiding hydraulic lock.

Figure 10:
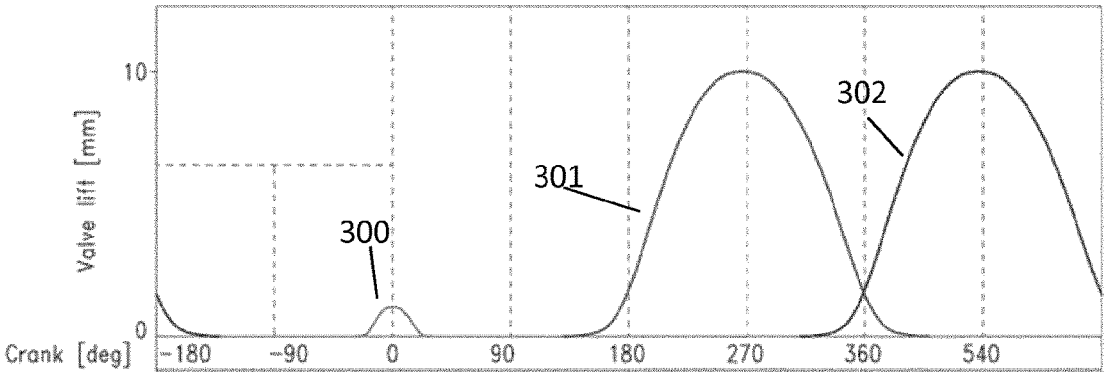
FIG. 10 shows a plot of valve lift against crank shaft rotation.

FIG. 10 illustrates valve lift against crank shaft rotation and the exhaust brake lift is labeled 300. The standard exhaust lift of the exhaust valves caused by the exhaust rocker arm 5 is labeled 301 and the standard intake lift of the intake valves 39, 41 caused by the intake rocker arm 3 is labeled 302.

Figure 11:
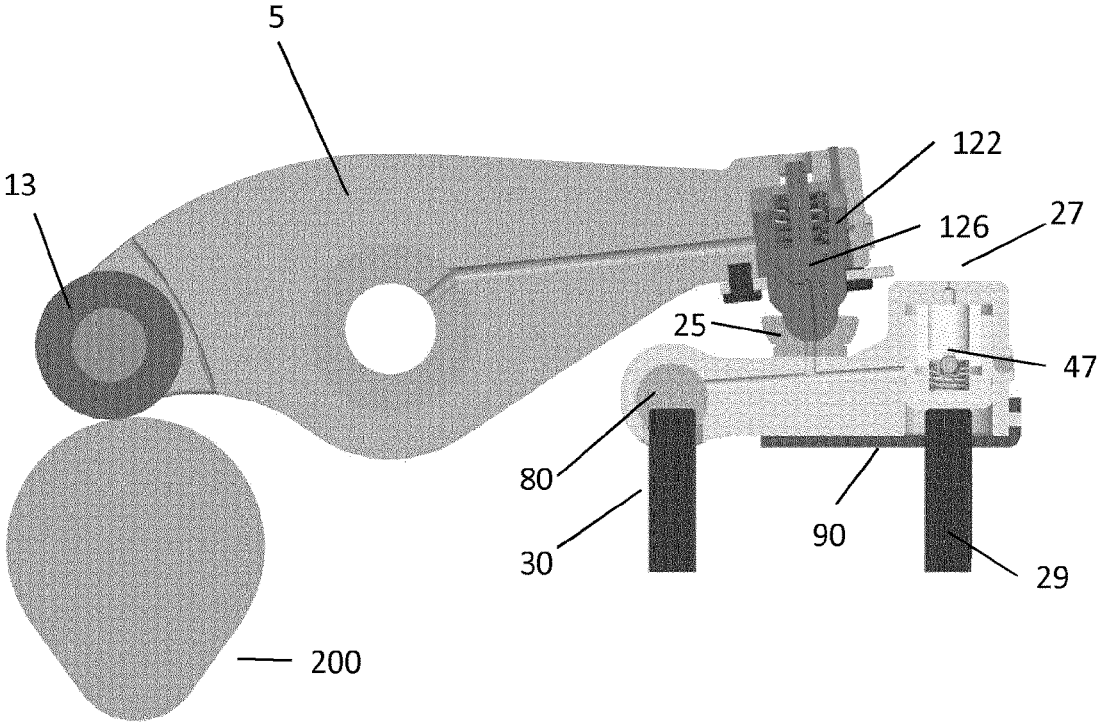
FIG. 11 shows a schematic cross sectional side view of part of an alternative valve train assembly.

FIG. 11 shows an alternative embodiment in which there is no separate exhaust brake rocker arm but instead the engine brake capsule 112 is contained in one end of the exhaust rocker arm 5. In this embodiment the push member 126 is connected to an E-Foot 25 which rests against the exhaust valve bridge 27. The roller 13 engages an exhaust cam which comprises a single cam profile 200 that incorporates both a main exhaust valve lift and a smaller exhaust brake lift. In operation, when the engine brake capsule 122 is in the engine brake 'ON' configuration, once per cam shaft rotation, the single cam profile 200 causes the exhaust brake rocker arm 5 to pivot about the rocker shaft 9 so that the engine brake capsule pushes down, via the elephant foot 25, on the valve bridge 27 to open both the exhaust valves 29 and 30 to provide an engine brake event timed coincident with a compression stroke of the piston. The exhaust valves 29 and 30 close under the action of valve return springs as the exhaust brake cam lobe passes out of engagement with the roller. Then, later in that cam shaft rotation, the single cam profile 200 causes the exhaust brake rocker arm 5 to pivot about the rocker shaft 9 so that there is a main lift of the exhaust valves 29 and 30 during the exhaust part of the engine cycle.

During engine operation when the engine brake is OFF, when the single cam profile 200 engages the roller causing the exhaust rocker arm 5 to pivot about the rocker shaft 9 during the part of the cycle that would produce the engine brake event in the engine brake 'ON' configuration, as with the embodiment described above, the first member 122 and the ring member 146 are free to move relative to the second member 124, which remains stationary throughout the movement of the rocker arm 5, and so no force transferred to the exhaust valves 29 and 30 which remain closed. Then, later in that cam shaft rotation, when the single cam profile again causes the exhaust brake rocker arm 5 to pivot about the rocker shaft 9, the first member 122 moves further and is brought into meshing contact with the second member 124. Consequently, the first member 122 and second member 124 then act as a solid body and as the rocker arm 5 continues its downward stroke a force is transferred to the exhaust valves 29 and 30 which open to provide a main exhaust valve event.

Further embodiments of the invention include a valve bridge for a valve train assembly, the valve bridge comprising a first cavity formed towards a first end portion of the valve bridge; and a hydraulic lash adjuster (HLA) disposed within the first cavity for engaging a first valve stem. The valve bridge may further comprise a second cavity, formed towards a second end portion of the valve bridge, containing a support member; wherein the valve bridge is supported for pivotal movement about the support member. The support member may be for engaging a second valve stem. The valve bridge may further comprise a clip member which supports the valve bridge and is clipped to the support member. The valve bridge may further comprise a contact surface at a second end portion of the valve bridge for engaging a second valve stem, wherein the contact surface is curved. The curved contact surface may be substantially part spherical. The HLA may comprise a contact surface for engaging the first valve stem, wherein the contact surface is curved. The curved contact surface may be substantially part spherical. The valve train assembly may further comprise a pivotally mounted first rocker arm for engaging the valve bridge and pivoting in response to a rotating first cam to cause a first valve lift event in an engine cycle. The first rocker arm may comprise a third cavity formed within an end portion thereof and a control capsule disposed within the third cavity, wherein the control capsule is configurable in an ON configuration and OFF configuration, wherein, in the ON configuration pivoting of the first rocker arm causes the first valve lift event and, in the OFF configuration, the control capsule prevents the pivoting of the first rocker arm from causing the first valve lift event. The first rocker arm may be for engaging the valve bridge and pivoting in response to the rotating first cam to also cause a second valve lift event in the engine cycle, wherein the second valve lift event occurs irrespective of whether the control capsule is in the ON configuration or the OFF configuration. The first rocker arm may be for engaging the HLA in the valve bridge and the assembly further comprises a second pivotally mounted rocker arm for engaging the valve bridge and pivoting in response to a rotating second cam to cause a second valve lift event in the engine cycle. The first valve event may be an engine brake valve event. The second valve lift event may be a main exhaust lift event.

The above embodiments are to be understood as an illustrative example of the invention only. Further embodiments of the invention are envisaged. For example, although the embodiments have been described in the context of a valve bridge used in a valve train that provides an engine brake function this need not be the case. A valve bridge embodying the present invention might be used to enable valve lift events other than those described above. Furthermore, equivalents and modifications not described above may also be employed without departing from the scope of the invention, which is defined in the accompanying claims.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The invention claimed is:

1. A valve train assembly, the valve train assembly comprising:

a valve bridge assembly, the valve bridge assembly comprising:

a valve bridge;

a first cavity formed towards a first end portion of the valve bridge; and a hydraulic lash adjuster (HLA) disposed within the first cavity, the HLA being configured to engage a first valve stem;

the valve train assembly further comprising:

a pivotally mounted first rocker arm configured to engage the valve bridge and to pivot in response to a rotating first cam to cause a first valve lift event in an engine cycle, wherein the first rocker arm comprises:

a rocker arm cavity formed within an end portion thereof; and a control capsule disposed within the rocker arm cavity, wherein the control capsule is configurable in an ON configuration and an OFF configuration, wherein, in the ON configuration, the pivoting of the first rocker arm is configured to cause the first valve lift event and, in the OFF configuration, the control capsule is configured to prevent the pivoting of the first rocker arm from causing the first valve lift event.

2. The valve train assembly according to claim 1, wherein the valve bridge assembly further comprises:

a contact surface at a second end portion of the valve bridge configured to engage a second valve stem, wherein the contact surface is curved.

3. The valve train assembly according to claim 2, wherein the curved contact surface is substantially part spherical.

4. The valve train assembly according to claim 1, wherein the HLA comprises a contact surface configured to engage the first valve stem, wherein the contact surface is curved.

5. The valve train assembly according to claim 4, wherein the curved contact surface is substantially part spherical.

6. The valve train assembly according to claim 1, wherein the first rocker arm is configured to engage the valve bridge and configured to pivot in response to the rotating first cam to cause a second valve lift event in the engine cycle, wherein the second valve lift event occurs irrespective of whether the control capsule is in the ON configuration or the OFF configuration.

7. The valve train assembly according to claim 1, wherein the first rocker arm is configured to engage the HLA in the valve bridge, and the valve train assembly further comprises a second pivotally mounted rocker arm configured to engage the valve bridge and to pivot in response to a rotating second cam to cause a second valve lift event in the engine cycle.

8. The valve train assembly according to claim 1, wherein the first valve event is an engine brake valve event.

9. The valve train assembly according to claim 7, wherein the second valve lift event is a main exhaust lift event.

* * * * *